US006061863A

United States Patent [19]

Chen

[11] Patent Number: 6,061,863

[45] Date of Patent: May 16, 2000

[54] MOP PROVIDED WITH MEANS TO ENHANCE WATER ABSORBING EFFECT THEREOF AND DURABILITY THEREOF

[76] Inventor: Hwa-Tien Chen, No. 23-42, Sha Tien Road, Tou Di Li, Sha Lu Chen, Taichung Hsien, Taiwan

[21] Appl. No.: 09/229,121

[22] Filed: Jan. 12, 1999

[51] Int. Cl.[7] ..... A47L 13/14

[52] U.S. Cl. ..... 15/119.2; 15/116.2

[58] Field of Search ..... 15/115, 116.1, 15/116.2, 119.1, 119.2, 147.1, 177, 260, 262

[56] References Cited

U.S. PATENT DOCUMENTS 2,235,264 3/1941 Rogers ..... 15/119.2
3,946,457 3/1976 Robinson ..... 15/119.1
5,172,446 12/1992 Schulein ..... 15/119.1
6,000,087 12/1999 Petner ..... 15/119.2

*Primary Examiner*—Robert J. Warden, Sr.
*Assistant Examiner*—Andrew Aldag
*Attorney, Agent, or Firm*—Browdy and Neimark

[57] ABSTRACT

A mop is composed of a rod, a head fastened with one end of the rod, two first press bars fastened with the head, a pull rod fastened pivotally with the rod, two connection rods fastened pivotally at one end thereof with the pull rod such that other end thereof is extended into the head, a colloidal cotton having a top edge which is disposed between the two first press bars and connected with free ends of the connection rods, and at least two second press bars fastened with the head such that the second press bars are parallel to the first press bars and that the second press bars and the first press bars are located side by side to rid the soaked colloidal cotton of water.

1 Claim, 3 Drawing Sheets

MOP PROVIDED WITH MEANS TO ENHANCE WATER ABSORBING EFFECT THEREOF AND DURABILITY THEREOF

FIELD OF THE INVENTION

The present invention relates generally to a cleaning implement, and more particularly to a mop which is durable and provided with means to enhance the water absorbing effect thereof.

BACKGROUND OF THE INVENTION

As shown in FIG. 1, a prior art mop 10 has a colloidal cotton 12. In operation, a pull rod 14 is pulled to actuate the colloidal cotton 12 to move upwards by two connection rods 15 such that the colloidal cotton 12 is held between the two press bars 1 of a pressing mechanism 16, as shown in FIG. 2. The colloidal cotton 12 is thus squeezed dry to be ready for cleaning the floor. As the colloidal cotton 12 picks up dirt on the floor, the colloidal cotton 12 is washed with head to remove therefrom dirt. The soaked colloidal cotton 12 is once again squeezed dry by the pressing mechanism 16 so as to be ready for cleaning the floor.

The prior art mop 10 has shortcomings. For example, the colloidal cotton 12 has a bottom edge, which is kept under the two press bars 17 at the time when the colloidal cotton 12 is actuated to move upward to locate at a dead point. This is to present the colloidal cotton 12 from being retracted into a head 11 of the mop 10, as illustrated by the solid lines in FIG. 2. If the bottom edge of the colloidal cotton is aligned with the press bars 17, the colloidal cotton located over the press bars is likely retracted into the head to separate from the press bars, as shown by the imaginary lines in FIG. 2. In view of the fact that the bottom edge of the colloidal cotton can not be squeezed, the colloidal cotton can not be squeezed dry in its entirety. As a result, the excessively wet colloidal cotton can not clean the floor effectively. In addition, the floor becomes wet and slippery. Moreover, after a prolonged use of the mop 10, the colloidal cotton is prone to shrink to be retracted into the head. The retraction of the colloidal cotton into the head may be also resulted from the fact that the colloidal cotton is connected by the pull rod 14 and the connection rods 15, and that the upper dead point of the colloidal cotton is prone to be dislocated. When the colloidal cotton is retracted into the head such that the colloidal cotton becomes separated from the press bars, the prior art mop 10 can not be used again due to the fact that the colloidal cotton can not be actuated to move by the pull rod.

SUMMARY OF THE INVENTION

It is therefore the primary objective of the present invention to provide a mop with a colloidal cotton which can be effectively squeezed dry to prevent the floor from becoming wet and slippery.

It is another objective of the present invention to provide a mop with a colloidal cotton which is kept durable.

The objectives, features and functions of the present invention will be readily understood upon a thoughtful deliberation of the following detailed description of a preferred embodiment of the present invention with reference to the accompanying drawings.

DETAILED DESCRIPTION OF THE INVENTION

Figure 2:
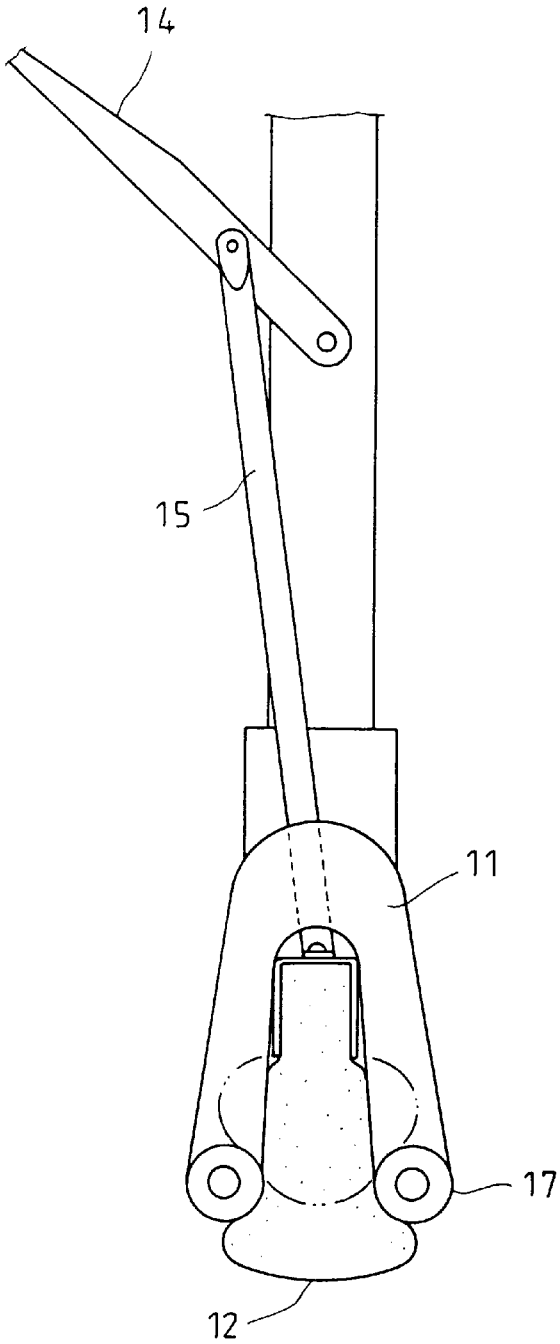
FIG. 2 PRIOR ART
FIG. 2 shows a schematic view of the prior art mop at work.
Figure 1:
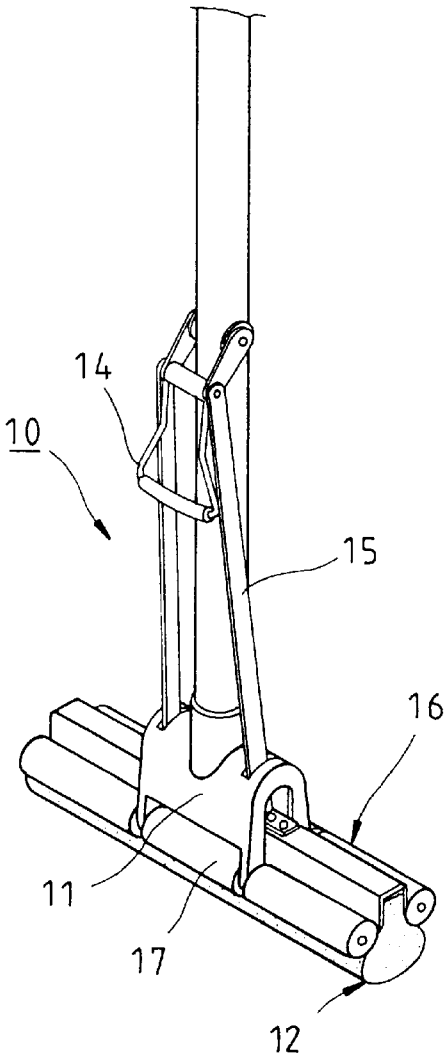
FIG. 1 PRIOR ART
FIG. 1 shows a perspective view of a prior art mop.
Figure 3:
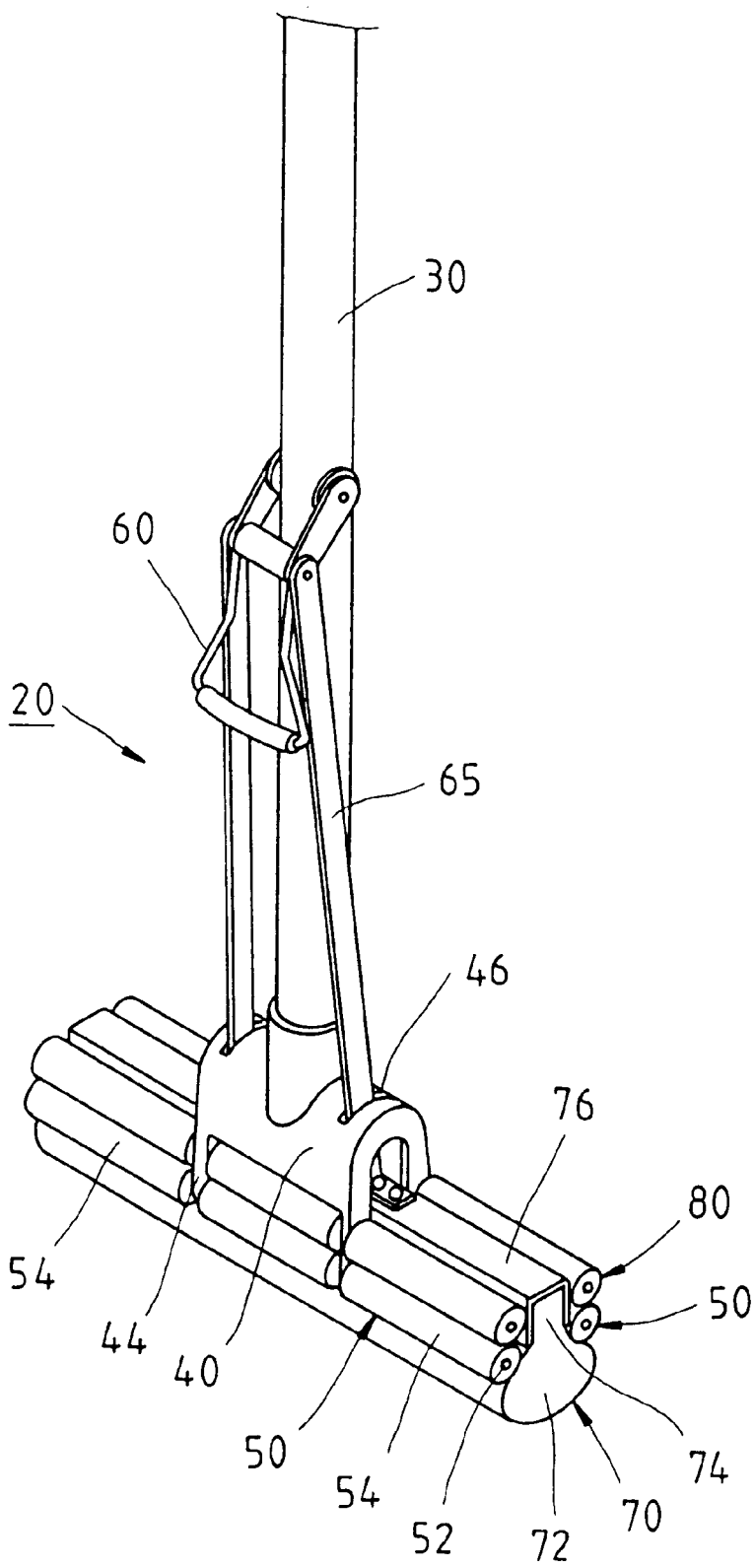
FIG. 3 shows a perspective view of the preferred embodiment of the present invention.
Figure 4:
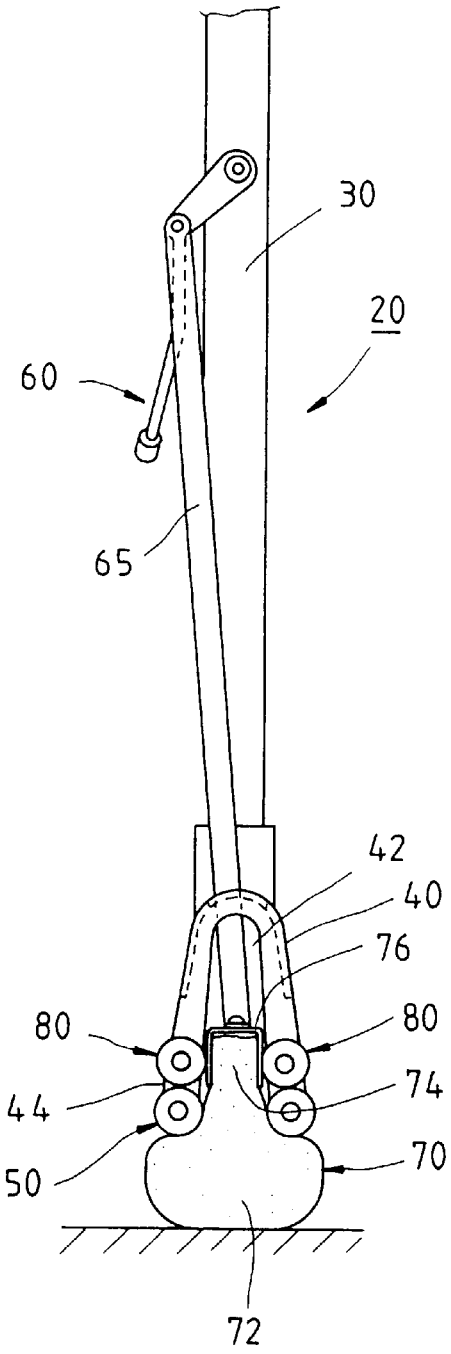
FIG. 4 shows a side view of the preferred embodiment of the present invention.

As shown in FIGS. 3 and 4, a mop 20 embodied in the present invention is composed of the component parts which are described hereinafter.

A rod body 30.

A head 40 has an inverted U-shaped cross section and is provided therein with a space 42. The head 40 is fastened with the bottom end of the rod body 30.

Two first press bars 50 have a shaft rod 52 and three rollers 54. The two press bars 50 are fastened side by side with the head 40 such that the two press bars 50 are parallel to each other, and that the shaft rod 52 is fastened with two columnar portions 44 of the head. The columnar portions are provided with through holes or indentations for the shaft rod to be put therethrough. The three rollers 54 are rotatably engaged with the shaft rod 52 such that one roller is located between two columnar portions 44, and that two rollers are located outside the two columnar portions.

A pull rod 60 is fastened pivotally with the rod body 30 such that the pull rod 60 can be pulled with hand.

Two connection rods 65 are fastened pivotally at one end thereof with the pull rod 60 such that other end thereof is extended into the space 42 via the through holes 46 of the head 40.

A colloidal cotton 70 is of a long striplike construction and has a cross section provided with a main body 72 with a greater outer diameter and a connection portion 74 with a smaller outer diameter. The connection portion 74 of the colloidal cotton 70 is disposed between the two press bars 50 and connected with the free ends of the two connection rods 65 by a clamping strip 76. The colloidal cotton 70 can be actuated by the connection rods to displace.

At least two second press bars 80 are fastened with two sides of the head 40 and are located over the first press bars 50 such that the second press bars 80 are parallel to the first press bars 50. The second press bars 80 are similar in construction to the first press bars 50.

Figure 5:
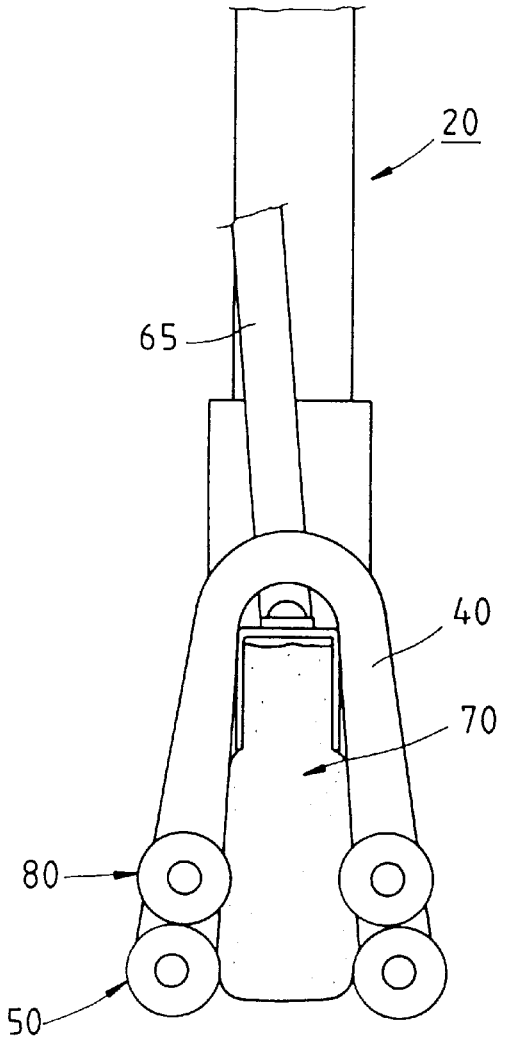
FIG. 5 shows a schematic view of the preferred embodiment of the present invention at work.

As shown in FIG. 4, the periphery of the main body 72 of the colloidal cotton 70 cleans the floor. When the colloidal cotton 70 is washed in water, it is soaked with water. As the pull rod 60 is pulled upwards, the colloidal cotton 70 is actuated by the connection rods 65 to move into the space 42 of the head 40. As the colloidal cotton 70 is moving into the space 42 of the head 40, the colloidal cotton 70 is pressed by the press bars 50 and 80 to deform to squeeze out the water from the colloidal cotton 70, as shown in FIG. 5.

In light of the present invention being provided with four press bars, the soaked colloidal cotton 70 can be effectively squeezed dry. In addition, the bottom edge of the colloidal cotton is flush with the first press bars 50 so as to increase the displacement distance of the colloidal cotton, thereby enabling the colloidal cotton to be squeezed in its entirety, as shown in FIG. 5. As the colloidal cotton is moved up to the dead point, the bottom edge of the colloidal cotton is flush with the first press bars 50, without causing the colloidal cotton to expand elastically over the two first press bars due to the fact that the colloidal cotton is confined by the two second press bars 80. As a result, the colloidal cotton is prevented from being retracted into the head 40. The colloidal cotton of the present invention is thus squeezed dry without being retracted to separate from the press bar.

According to the test done by this inventor of the present invention, the colloidal cotton of the present invention is squeezed dry such that the amount of water kept in the colloidal cotton is one third less than the amount of water kept in the colloidal cotton of the prior art mop.

The present invention is provided with press bars 50 and 80, which are arranged at various levels instead of only one level of the prior art. As a result, the colloidal cotton of the present invention is confined by the press bars such that the colloidal cotton can not be moved into the head even if the colloidal cotton has shrunk after a prolonged use and even if the colloidal cotton has been frequently actuated by the pull rod 50 and the connection rods 55 to cause the upper dead point of the colloidal cotton to separate from the originally-designed position.

What is claimed is:

1. A mop comprising:

a rod body;

a head provided at a bottom thereof with an opening and in an interior thereof with a space, said head being fastened with a bottom end of said rod body;

two first press bars fastened on two sides of said head such that said two first press bars are parallel to each other and on opposite sides of said head;

a pull rod fastened pivotally with said rod body;

two connection rods fastened pivotally at one end thereof with said pull rod such that other end thereof is extended into said space of said head; and an absorbent body having a top edge which is disposed between said two first press bars and connected with free ends of said two connection rods;

wherein said head is provided with at least two second press bars fastened on opposite sides of said head such that said second press bars are parallel to said first press bars and said first press bars are fastened at a different distance from the opening of said head than said second press bars, and that said absorbent body can be pressed by said first press bars and said second press bars to rid said absorbent body of water contained in said absorbent body.

* * * * *